US011035521B2

(12) United States Patent
Pierce

(10) Patent No.: US 11,035,521 B2
(45) Date of Patent: Jun. 15, 2021

(54) METHOD AND SYSTEM FOR CONTROL OF PRESSURE WASHER FUNCTIONS

(71) Applicant: SAPPHIRE SCIENTIFIC INC, Prescott, AZ (US)

(72) Inventor: Martin Elliot Pierce, Littleton, CO (US)

(73) Assignee: LEGEND BRANDS, INC., Burlington, WA (US)

( * ) Notice: Subject to any disclaimer, the term of this patent is extended or adjusted under 35 U.S.C. 154(b) by 423 days.

(21) Appl. No.: 14/696,127

(22) Filed: Apr. 24, 2015

(65) Prior Publication Data

US 2015/0306614 A1 Oct. 29, 2015

Related U.S. Application Data

(60) Provisional application No. 61/984,623, filed on Apr. 25, 2014, provisional application No. 61/985,915, filed on Apr. 29, 2014.

(51) Int. Cl.

| | |
|---|---|
| ***F17D 3/01*** | (2006.01) |
| ***B05B 9/00*** | (2006.01) |
| ***B05B 12/00*** | (2018.01) |
| ***F02D 9/02*** | (2006.01) |
| ***B05B 13/00*** | (2006.01) |
| ***B08B 3/02*** | (2006.01) |

(Continued)

(52) U.S. Cl.

CPC ..... *F17D 3/01* (2013.01); *B05B 9/007* (2013.01); *B05B 12/006* (2013.01); *B05B 15/58* (2018.02); *B05B 15/65* (2018.02); *B08B 3/026* (2013.01); *F17D 1/20* (2013.01); *B05B 13/005* (2013.01); *F02D 2009/023* (2013.01)

(58) Field of Classification Search

None

See application file for complete search history.

(56) References Cited

U.S. PATENT DOCUMENTS 5,046,665 A 9/1991 Kor et al.
5,081,973 A * 1/1992 Minamitani ..... F02D 31/005 123/339.11

(Continued)

FOREIGN PATENT DOCUMENTS

| | | |
|---|---|---|
| CN | 102500492 | 6/2012 |
| CN | 202799823 | 3/2013 |
| WO | WO 2012/013574 | 2/2012 |

OTHER PUBLICATIONS

"EHW: All-Electric Hot Water Pressure Washer," Landa, Jun. 2011, 2 pages.

(Continued)

*Primary Examiner* — Peter J Bertheaud
*Assistant Examiner* — Geoffrey S Lee
(74) *Attorney, Agent, or Firm* — Perkins Coie LLP

(57) ABSTRACT

Methods and systems for controlling pressure washer devices are provided. Pressure washers comprising at least one control unit and the ability to regulate functions of at least an engine of a pressure washer are disclosed. A control unit receives inputs from a user or various sensors provided in communication with the control unit, and is further capable of outputting a signal based on the inputs, the output signal operative to maintain or control the operating functions of an engine, pump, or motor.

23 Claims, 4 Drawing Sheets

(51) Int. Cl.

| | |
|---|---|
| ***F17D 1/20*** | (2006.01) |
| ***B05B 15/65*** | (2018.01) |
| ***B05B 15/58*** | (2018.01) |

(56) References Cited

U.S. PATENT DOCUMENTS

| | | | | | |
|---|---|---|---|---|---|
| 5,186,142 | A * | 2/1993 | Brunelli | B08B 3/026 | 123/339.16 |
| 5,228,622 | A * | 7/1993 | Murphy | B05B 7/24 | 239/126 |
| 5,282,722 | A * | 2/1994 | Beatty | B05B 12/085 | 417/15 |
| 5,383,605 | A * | 1/1995 | Teague | B05B 12/00 | 239/526 |
| 5,529,460 | A | 6/1996 | Eihusen et al. | | |
| 5,580,221 | A * | 12/1996 | Triezenberg | F04B 47/06 | 417/12 |
| 5,848,877 | A * | 12/1998 | Dill | F04B 49/065 | 417/44.2 |
| 5,871,152 | A | 2/1999 | Saney | | |
| 6,031,352 | A * | 2/2000 | Carlson | G05B 11/28 | 318/811 |
| 6,123,509 | A * | 9/2000 | Hung | F04B 49/022 | 137/565.35 |
| 6,152,105 | A * | 11/2000 | Nishimura | F02D 37/02 | 123/339.11 |
| 6,419,456 | B1 * | 7/2002 | Cooper | F04B 17/03 | 200/82 A |
| 6,648,603 | B2 * | 11/2003 | Dexter | F04B 49/02 | 417/234 |
| 6,651,900 | B1 * | 11/2003 | Yoshida | A62C 25/00 | 169/13 |
| 7,422,164 | B2 | 9/2008 | Matsumoto | | |
| 8,037,844 | B2 | 10/2011 | Mather et al. | | |
| 8,038,413 | B2 * | 10/2011 | Gilpatrick | B08B 3/026 | 417/34 |
| 8,135,529 | B2 * | 3/2012 | Liao | F04D 15/0066 | 417/12 |
| 8,425,203 | B2 * | 4/2013 | Gardner | B08B 3/026 | 417/234 |
| 8,459,958 | B2 * | 6/2013 | Renner | B66C 23/42 | 219/133 |
| 8,496,188 | B2 * | 7/2013 | Linton | B08B 3/026 | 137/563 |
| 8,616,180 | B2 * | 12/2013 | Spitler | B08B 3/026 | 123/339.1 |
| 8,662,857 | B2 * | 3/2014 | Hukriede | F04B 17/05 | 222/315 |
| 8,726,882 | B2 * | 5/2014 | Raasch | F02D 31/00 | 123/389 |
| 8,905,152 | B2 * | 12/2014 | Kling | A62C 33/00 | 169/23 |
| 8,915,231 | B2 * | 12/2014 | Raasch | F02D 31/00 | 123/363 |
| 9,051,927 | B2 * | 6/2015 | Gilpatrick | F04B 17/03 | |
| 9,316,216 | B1 * | 4/2016 | Cook | F04B 23/06 | |
| 2002/0035868 | A1 * | 3/2002 | Muto | G01F 1/6965 | 73/204.27 |
| 2005/0107896 | A1 | 5/2005 | Kucera et al. | | |
| 2008/0014096 | A1 * | 1/2008 | Gilpatrick | B08B 3/026 | 417/34 |
| 2011/0052415 | A1 * | 3/2011 | Renner | B66C 23/42 | 417/11 |
| 2011/0189032 | A1 * | 8/2011 | Hukriede | F04B 17/05 | 417/364 |
| 2011/0315176 | A1 * | 12/2011 | Gilpatrick | B08B 3/026 | 134/57 R |
| 2012/0020809 | A1 * | 1/2012 | Gilpatrick | B08B 3/026 | 417/26 |
| 2012/0169504 | A1 | 7/2012 | Hillger et al. | | |
| 2013/0092745 | A1 * | 4/2013 | Karp | B08B 3/026 | 239/1 |
| 2013/0111865 | A1 | 5/2013 | Hansen et al. | | |
| 2013/0193231 | A1 | 8/2013 | Mologousis | | |
| 2013/0214059 | A1 | 8/2013 | Gilpatrick et al. | | |
| 2013/0216402 | A1 * | 8/2013 | Raasch | F04B 17/03 | 417/212 |
| 2013/0277451 | A1 * | 10/2013 | Gilpatrick | A01G 25/145 | 239/68 |
| 2014/0231537 | A1 * | 8/2014 | Hukriede | F04B 17/05 | 239/101 |
| 2016/0067726 | A1 * | 3/2016 | Gilpatrick | B05B 7/32 | 239/526 |

OTHER PUBLICATIONS

"Encore XT Manual Powder Spray System," Nordson Corporation, Oct. 2011, 4 pages [Retrieved on Oct. 13, 2013 from http://www.nordson.com/en-gb/divisions/industrial-coating/Literature/Powder%20Coating/Encore%20XT%20English%202011.pdf].

"G 4000 OH 4000psi gas Pressure Washer," Karcher, 2013, 2 pages [retrieved from: http://www.buykarcher.com/product_detail.asp?HDR=GASPWPROF&T1=KAR+11948010].

"Hydroblaster™ Remote Equipment Module (REM)," Hydro Engineering, Inc., Jun. 2010, 1 page.

"Pressure Washer Remote Control Stations," Hydro Engineering, Inc., © 2004, 3 pages [retrieved from: http://www.hydroblaster.com/products/RemoteStations.htm].

"Pressure Washers are operated by wireless remote control." ThomasNet, Nov. 21, 2006, 3 pages [retrieved from: http://news.thomasnet.com/fullstory/Pressure-Washers-are-operated-by-wireless-remote-control-499867].

"Pro-Control: Product Information Bulletin," Hydro-Chem Systems, Inc., Dec. 2006, 1 page.

"Pro Control Pressure Washer Remote System," Hydro-Chem Systems, Inc., © 2006, 1 page [retrieved from: http://hydrochemsystems.com/services.22.139.pro_control_pressure_washer_remote_system.htm].

"Remote control operates pressure washers at a distance," FoodProduction Daily, Nov. 2006, 4 pages [retrieved from: http://www.foodproductiondaily.com/Processing/Remote-control-operates-pressure-washers-at-a-distance].

"SEA: Stationary, electric-Powered, Cold Water Pressure Washer," Landa, Nov. 2014, 2 pages [Retrieved on Oct. 11, 2013 from http://landanw.com/media/SEA.pdf].

"Spartan Warrior Water Jet Owners Manual," Spartan Tool L.L.C., 2011, 92 pages [retrieved from: http://www.spartantool.com/filebin/productmanual/Warrior_Manual_5-17-11.pdf].

"Truck mount with remote controlled start and shut down." TruckMountForums, Nov. 2012, 42 pages.

"Wireless remote systems," PressureNet, 2007, 5 pages [retrieved from: http://www.pressurenet.net/forum/index.php?showtopic=920].

McCormick "Hydroblaster™ Model MultiBlaster (In Plant Multi-station Controller)," Hydrro Engineering, Inc., Aug. 2007, 1 page.

* cited by examiner

METHOD AND SYSTEM FOR CONTROL OF PRESSURE WASHER FUNCTIONS

This U.S. Non-Provisional Patent Application claims the benefit of priority from U.S. Provisional Patent Application 61/984,623, filed Apr. 25, 2014, and U.S. Provisional Patent Application 61/985,915, filed Apr. 29, 2014, the entire disclosures of which are hereby incorporated by reference in their entireties.

BACKGROUND

Pressure washers use high pressure liquid, typically water, to clean surfaces such as driveways, decks, walls, and the like. Generally, pressure washers include an engine that provides power to a pump. The pump operates to provide high pressure fluid to a wand or a gun that includes a trigger mechanism that is actuated by the user to discharge the high pressure fluid. Generally, the user squeezes the trigger with one hand and supports the discharge end of the gun with the other hand during use. During periods when high-pressure water is not required, the user releases the trigger and high-pressure water from the pump discharge is directed back to the pump intake.

SUMMARY

Embodiments of the present disclosure relate to pressure washers that are powered by an engine and a pump. More specifically, the present disclosure relates to controlling and regulating engine activity and performance, such as the engine's revolutions per minute ("RPM"). In certain embodiments, the present disclosure provides one or more controls for an engine that provides power for a pressure washer, wherein the one or more controls monitor various parameters, such as vacuum pressure, water temperature, and water pressure.

In certain embodiments, various sensors are employed to automatically control a system. At least one sensor feedback is provided to the control system and automatically set the RPM and/or other machine parameters. The operator can utilize the auto control, or manually override to return to manual control. Using a pressure transducer or similar sensor to monitor a water pressure within a pressure washer and a vacuum gauge or similar device to monitor a vacuum pressure within an engine of a pressure washer device, the control system provides constant or systematic monitoring of engine and pump parameters that indicate usage or non-use of pressure washing activities. For example, when a water trigger is depressed on the tool, a signal is sent back to the system control(s) to initiate a return of the engine to working RPM ranges. The present disclosure contemplates various embodiments wherein at least one sensor is provided to monitor and control at least one device parameter. In certain embodiments, devices are provided that do not comprise an on-board ECU (electronic control unit) wherein automatic control of a manual idle throttle can be achieved with the addition of an actuator controlled by the main control system.

In various embodiments, at least one display or user interface is provided on a pressure washer device to provide direct feedback of device settings to the operator. Such settings include, for example, RPM, temperature, pressure and various other measurements and diagnostics related to system performance. Using one or more sensors, embodiments of the present disclosure electronically transmit (via wire or wirelessly) information to a display provided locally on the device, such as on the spray gun or wand, or at a remote location (e.g. truck, office, etc.).

In certain other embodiments, an external device is provided and adapted to control device parameters. Such external devices include, but are not limited to smartphones, tablets, and PCs. Such embodiments provide for automatic and/or manual control of a device without a need for direct contact with a device. Such embodiments provide a device with enhanced control and monitoring features. In certain embodiments, smart phone technology is provided to adjust a series of relays to vary engine RPM and various other machine parameters.

U.S. Patent Application Publication No. 2013/0214059 to Gilpatrick et al., which is hereby incorporated by reference in its entirety, discloses a water spraying system including a spray gun with an electronic display and circuitry configured to provide a graphical user interface on the display. Embodiments of the present disclosure contemplate providing such features, including those wherein information related to device operation is conveyed to a user and wherein a user may control device operations via the user interface. U.S. Pat. No. 8,037,844 to Mather et al., which is hereby incorporated by reference in its entirety, discloses a control method and apparatus provided on a spray gun. Embodiments set forth in the present disclosure contemplate incorporating various features of Mather et al., including a graphical user interface on a spray gun and wherein the spray gun comprises means to control the function(s) of a related device. U.S. Patent Application Publication No. 2005/0107896 to Kucera et al. which is hereby incorporated by reference in its entirety provides a remote control system which may be retrofit in existing sprayers. Such features are contemplated by various embodiments of the systems disclosed herein.

U.S. Pat. No. 8,038,413 to Gilpatrick, which is hereby incorporated by reference in its entirety, discloses an idle down controller that is responsive to a drop in pressure at a pump outlet. Such features are contemplated for use in various embodiments of the presently disclosed systems. U.S. Pat. No. 6,648,603 to Dexter et al., which is hereby incorporated by reference in its entirety, discloses an engine idle controller for a pressure washer. Various features of Dexter, including features wherein an engine speed is at least partially controlled by the valve of an associated wand, are contemplated by various embodiments of the disclosed systems. U.S. Pat. No. 5,186,142 to Brunelli et al., which is hereby incorporated by reference in its entirety, discloses an idling system with a speed governor comprising an electromagnet that interacts with a governor lever arm. Various features of Brunelli are contemplated by various disclosed. U.S. Pat. No. 5,529,460 to Eihusen et al., which is hereby incorporated by reference in its entirety, discloses a pressure washer with a flow control switch and a bypass. Various features of Eihusen, including features wherein a bypass relieves excess outlet pressure and activates a flow control switch, are contemplated for use with the present invention. U.S. Patent Application Publication No. 2013/0092745 to Karp, which is hereby incorporated by reference in its entirety, discloses a pressure washer with a timed controlled wherein the engine or motor is deactivated if the spray gun is not operated for a certain period of time. Such features are contemplated by various embodiments of the disclosed systems.

In one embodiment, a pressure washer device is provided, the device comprising an engine having a throttle responsive to control signals to control an engine speed, a pump in communication with and powered by the engine that discharges a fluid under pressure, a spray gun in communication with the pump for dispensing a fluid, a control unit in communication with the engine, a first sensor in communication with the engine and the control unit, the first sensor adapted to measure a vacuum pressure associated with the engine, a second sensor in communication with the pump and the control unit, the second sensor adapted to measure a fluid pressure associated with the pump, and a third sensor in communication with the at least one of the engine and the pump and the control unit, the third sensor adapted to measure a temperature of at least one of: the engine, a fluid in the pump, and the pump. The control unit is in communication with the engine to control an engine function, and the engine function comprises at least one of engine speed, fuel consumption, and air intake.

In another embodiment, a pressure washer is provided, the pressure washer comprising an engine having a throttle responsive to control signals, a pump in communication with the engine, the pump operative to pressurize a fluid, a dispensing device in fluid communication with the pump, a vacuum sensor in communication with the engine to detect a vacuum pressure within the engine, a pressure sensor in communication with the engine to detect a fluid pressure within the pump, and a control unit in communication with the vacuum sensor, the pressure sensor, and the throttle. The control unit is adapted to receive and process signals from the vacuum sensor and the pressure sensor and send signals to the throttle to control at least one engine function.

In various embodiments, the present disclosure provides a pressure washer comprising a dispensing device such as a spray gun or wand wherein the dispensing device is capable of sending a user-generated signal or command to a control unit of the pressure washer. For example, in certain embodiments, a dispensing device comprises a spray gun capable of sending a signal to a control device when a user conducts a specific operation or input. In some embodiments, the input comprises a predetermined operation (e.g. three pulses of a trigger within a certain timeframe). Such an input provides a signal to the control unit to perform a specific function, such as increase or decrease the speed of the engine. In other embodiments, the dispensing device comprises one or more user-interfaces or contact points to perform specific functions. For example, in certain embodiments, a dispensing device comprises a dedicated button or switch to send a specific signal to the control unit and/or engine. The spray gun may comprise a button or switch to control device functions. In still other embodiments, such control features may be provided external to the device and/or dispensing device. Various embodiments of the present disclosure contemplate providing a remote control device that may be carried by a user or maintained in a utility vehicle, the remote control device adapted to send signals to a control unit of a pressure washer based on user inputs.

In certain embodiments, methods of controlling one or more operating functions of a pressure washer are provided. In one embodiment, a method for automatically controlling operating functions of a pressure washer engine is provided, the method comprising the steps of providing a pressure washer comprising an engine, a pump, and a control unit in communication with the engine and at least one sensor, activating the pressure washer by starting the engine, providing power to the control unit, initializing a loop wherein the control unit continuously monitors the at least one sensor to determine whether a predetermined event has occurred, based on the occurrence of the predetermined event, providing a signal from the control unit to the engine to automatically change at least one operating function of the pressure washer, and subsequent to changing the at least one operating function of the pressure washer, initiating a second loop to continuously monitor the at least one sensor to determine whether a second predetermined event has occurred.

In various embodiments of the present disclosure, a method of operating a pressure washer device is provided. In one embodiment, a method is provided comprising the steps of: powering on a pressuring washing device; selectively powering on or otherwise activating an auto-idle feature of the device and thereby initiating a program and beginning a counter. In various embodiments, the counter comprises a seven-second counter, but it will be recognized that the specific duration of the counter is not critical to the disclosure and any number of durations for the counter may be provided. Once the limit of the counter is reached, a relay contact opens and the device idles down from a working speed to an idle speed. The device, system, or program then enters a loop wherein at least a water pressure within the device is monitored. During the loop, if a 25% or greater change in water pressure is identified (such as may occur when a water trigger is activated and/or cleaning operations are commenced), the relay contact is closed and the engine idle speed is returned to a normal or working speed. Once the device has returned to the normal or working idle speed, a loop is initiated to monitor at least one of water pressure within a pump and vacuum pressure within an internal combustion engine provided within the device. In certain embodiments, if a water pressure change of at least approximately fifteen percent is perceived by the device and less than approximately twenty percent change in vacuum pressure is perceived, the counter will continue to increment. In this condition, the device has recognized that cleaning operations are occurring or have recently occurred and engine conditions (RPM, power, etc.) should be maintained. If a vacuum pressure change is at least approximately twenty-five percent or more, the counter is reset to zero, as such a condition is generally indicative of continued use of the device and/or continued pressure washing activities. If the counter reaches a duration of at least approximately twenty seconds without pressure sensor devices indicating that cleaning operations or use of the device has occurred within this period, the contact relay opens and the machine idles down. In various embodiments, the device is returned to normal working conditions by simply activating a fluid-dispensing device and thereby inducing a pressure and/or vacuum change to indicate that normal operations should be resumed. Additionally, in certain embodiments, the device may be manually activated to reduce engine idle. In one embodiment, for example, three quick pulses of a trigger mechanism send a signal to open the relay and idle-down the engine. The three pulses should preferably occur within a short time frame (1-2 seconds, for example). Additionally, various embodiments of the present disclosure contemplate that the auto-idle features as shown and described herein need not be used, and may be over-ridden or turned-off when desired. Although various embodiments described prescribe certain values for certain conditions to exist, it will be recognized that no limitation with respect to such values is provided. Such values are provided as illustrative of certain embodiments, and the present disclosure is not limited to such values.

Figure 1:
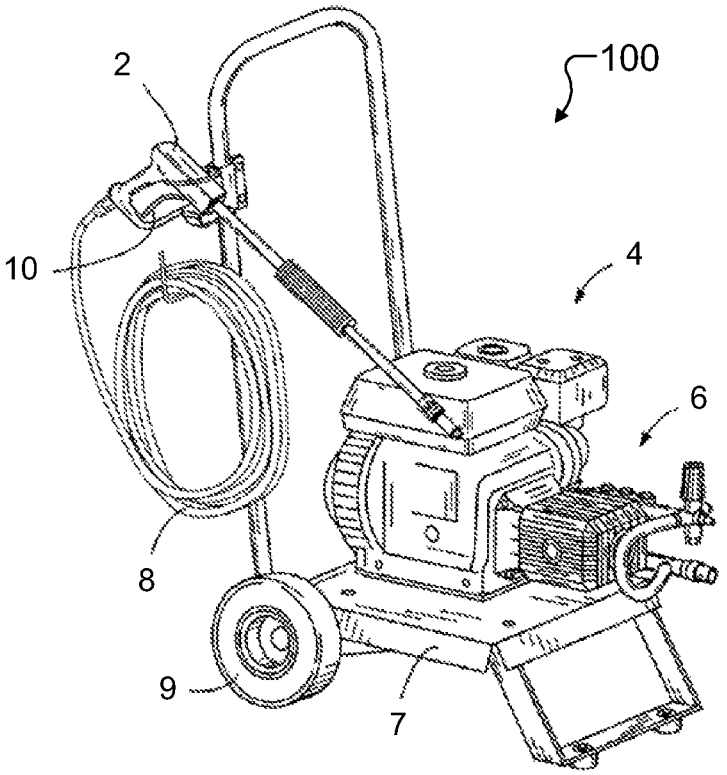
FIG. 1 is a perspective view of a pressure washer according to one embodiment of the present disclosure.

To assist in the understanding of the present disclosure the following list of components and associated numbering found in the drawings is provided herein:

Table of Components

| Component | # |
|---|---|
| Gun | 2 |
| Engine | 4 |
| Pump | 6 |
| Frame | 7 |
| Hose | 8 |
| Wheels | 9 |
| Trigger Assembly | 10 |
| Frame | 12 |
| Wheels | 14 |
| Tow Hitch | 16 |
| Trailer | 17 |
| Tank | 18 |
| Side Tanks | 20 |
| Hose Reel | 22 |
| Hose | 24 |
| Pump | 26 |
| Engine | 28 |
| Vented Panel | 30 |
| Heater Module | 32 |
| Sub-Frame | 34 |
| Rails | 36 |
| Heater | 38 |
| Header Tank | 40 |
| Heat Exchanger | 42 |
| Control Panel And Status Indicator | 44 |
| Hoses | 46 |
| Hoses | 48 |
| Buffer Tank | 50 |
| Rear Panel | 52 |
| Battery | 54 |
| Engine | 56 |
| Microprocessor Control Unit | 58 |
| Water Transducer | 60 |
| Temperature Sensor | 62 |
| Vacuum Gauge | 64 |
| Speed Control Relay | 66 |
| Speed Control Switch | 68 |
| Pressure Washer | 100 |
| Trailer Mounted Pressure Washer | 200 |

DETAILED DESCRIPTION

Referring now to FIG. 1, a pressure washer 100 comprising a gun 2 in shown. FIG. 1 illustrates one possible pressure washer 100 that employs control features according to embodiments of one disclosed system and as shown and described herein. As one of ordinary skill will recognize, the systems described herein are suitable for use with most pressure washers that output a pressurized liquid. As such, the disclosure is not limited to pressure washer 100 illustrated in FIG. 1 or trailer mounted pressure washers 200 illustrated in FIG. 2.

The pressure washer 100 of the depicted embodiment comprises a hand movable mobile pressure washer that includes a trigger-actuated gun, wand, or tool, simply referred to as gun 2. Pressure washer 100 also comprises an internal combustion engine 4 and a pump 6 mounted to a chassis or frame 7. The frame 7 comprises at least one wheel 9 to facilitate movement of the device 100. The device 100 comprises an engine 4 that drives a pump 6. The pump 6 draws fluid, typically water, from a source (e.g., an onboard reservoir, a garden hose, an external tank, etc.) and selectively delivers the fluid to the gun 2 via a hose 8, under pressure. The gun 2 includes trigger assembly 10 that allows a user to selectively discharge a flow of water from the gun 2. Typically, a user actuates the trigger assembly 10 to open a valve (not shown) and begin the discharge of high-pressure fluid. When the user disengages trigger assembly 10, the valve closes, and fluid flow is inhibited from exiting the gun 2.

Figure 2:
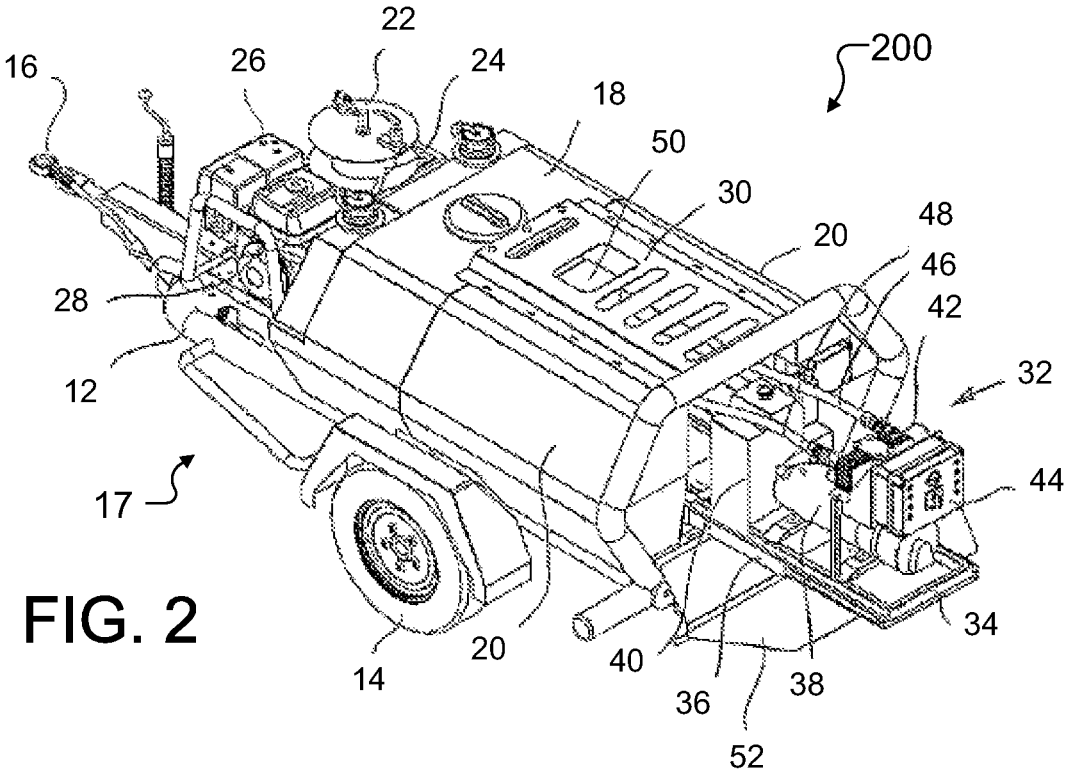
FIG. 2 is a perspective view of a trailer mounted pressure washer according to one embodiment of the present disclosure.

FIG. 2 is a perspective view of a pressure washer 200 according to another embodiment of the disclosure and wherein the pressure washer 200 comprises a trailer-mounted pressure washer. The pressure washer 200 comprises a chassis or frame 12 having wheels 14 and a tow hitch 16 to form a trailer or towable unit 17. A cold water tank arrangement is supported by the frame 12, and comprises a front container or tank 18 (with respect to the normal travel direction of the trailer 17 when towed by means of tow hitch 16) and two side containers or side tanks 20. At the front end of the trailer 17, i.e., the end towards tow hitch 16, a hose reel 22 is provided to stow and carry a hose 24 to which, in use, a delivery device in the form of a gun (not shown in FIG. 2, but see gun 2 of FIG. 1) is connected. A high pressure pump 26 driven by a gas or diesel engine 28 is mounted on the main frame 12.

The side tanks 20 are spaced apart from each other and define between them an accommodation space which is covered by a vented panel 30. A heater module 32 is provided and carried by a sub-frame 34 mounted on the main frame 12 by means of sliding, telescoping rails 36 which enable the heater module 32 to be moved between an access position shown in FIG. 2 by opening a rear panel 52, and a refracted operative position (not shown), in which the heater module 32 is situated in the accommodation space between the side tanks 20. In certain embodiments, the heater module 32 comprises an oil-fired heater 38, a header tank 40, a heat exchanger 42, and a control panel and status indicator 44.

Also visible in FIG. 2 are inlet and outlet hoses 46, 48 connected to the heat exchanger 42 by respective quick-connect couplings or other suitable devices. A buffer tank 50 is provided and within the accommodation space beneath the vented panel 30.

FIGS. 1-2 depict two embodiments of a pressure washer device that may be provided with various features of the present disclosure. However, no limitation with respect to devices or pressure washers which may employ various novel features of the present disclosure is provided herewith. It will be understood that FIGS. 1-2 are merely examples of embodiments that may comprise various features described herewith and are provided for illustrative purposes only.

Figure 3:
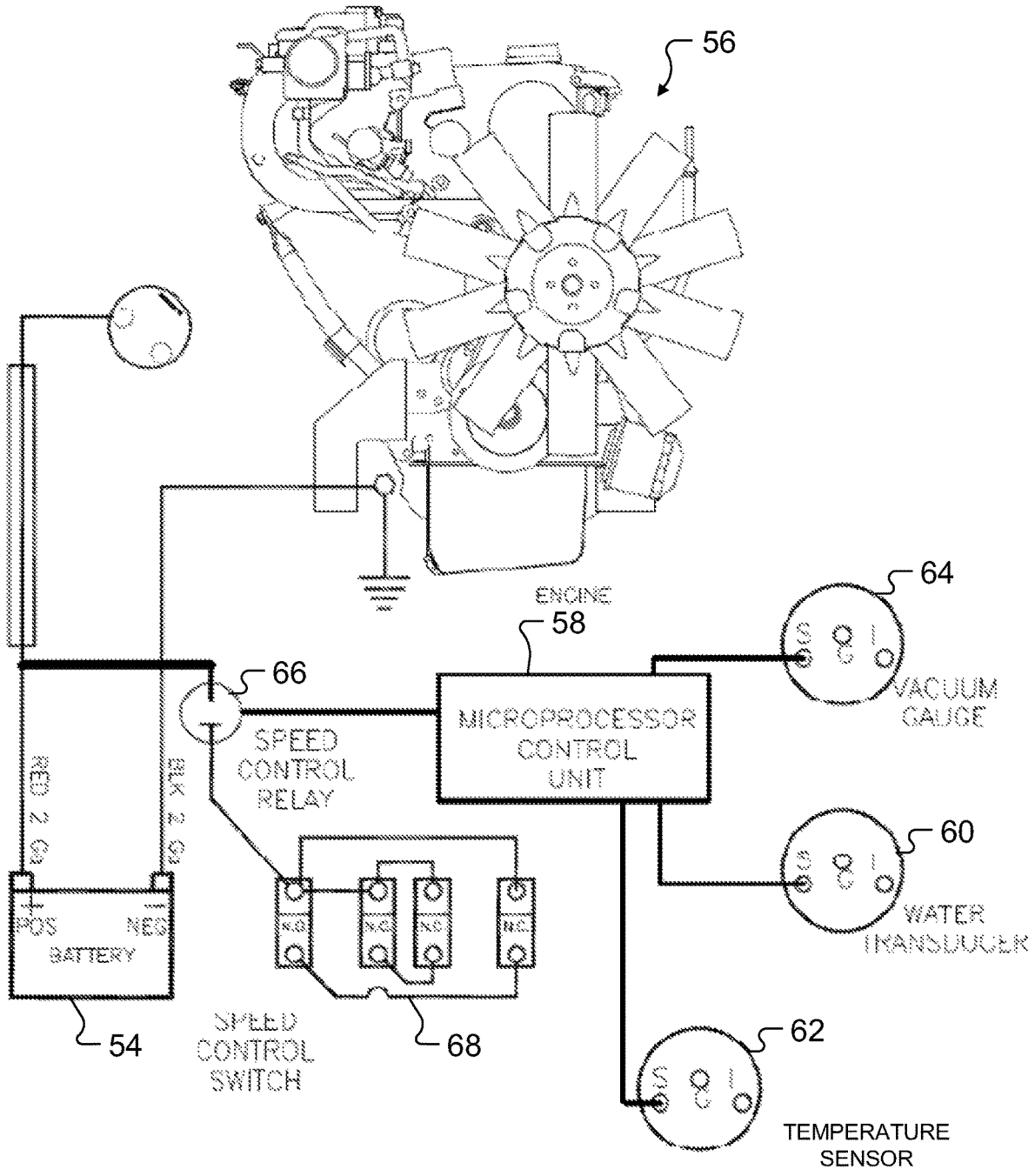
FIG. 3 is a schematic wiring diagram according to one embodiment of the present disclosure.

FIG. 3 is schematic wiring diagram of an electronic control unit auto idle system in accordance with one embodiment of the present disclosure. Referring now to FIG. 3, a battery 54 provides electrical power to an engine 56 and/or control unit 58. It will be recognized that although FIG. 3 provides an engine 56 in accordance with one embodiment, features of FIG. 3 shown and described herein may be used with other devices including, but not limited, those shown in FIGS. 1-2.

In various embodiments, the microprocessor control unit 58 is in communication with at least one transducer 60, the transducer 60 being capable of monitoring at least one water pressure within the system. The control unit 58 is also provided in communication with at least one temperature sensor 62 (e.g. thermocouple), and/or a vacuum gauge 64. The transducer 60, temperature sensor 62, and vacuum gauge 64 may be electrical devices, mechanical devices, or electro-mechanical devices, as will be recognized by one of ordinary skill in the art. The microprocessor control unit 58 monitors one or more system parameters, and based on information received from one or more sensors 60, 62, 64 related to one or more parameters, the control unit 58 regulates engine function(s), such as RPM and other machine parameters. Such control is advantageous in order to save fuel, reduce emissions, control noise output and maintain a desirable pressure associated with a fluid, for example. By utilizing the various sensors, individually or in combination with each other, the pressure washer may be automatically controlled. An operator is not required to be near the unit or otherwise monitor and control the unit. The sensor feedback to microprocessor control unit 58 allows microprocessor control unit 58 to send signals to speed control relay 66 and speed control switch 68 to automatically set the RPM and other machine parameters. An operator can utilize the auto control, or manually override to return to manual control.

Using a water transducer 60 to monitor water pressure and/or a vacuum gauge 64 to monitor vacuum pressure, the microprocessor control unit 58 of certain embodiments is provided to monitor changes (or lack thereof) in at least one of water pressure within the device and vacuum pressure within the engine (e.g. manifold vacuum pressure) in order to automatically adjust device functioning (e.g. engine RPM). When pressure washer functions are activated or deactivated, such as by pressing or releasing a trigger assembly of the spray gun, a signal is provided to microprocessor control unit 58 indicating such an event, and engine functioning (e.g. RPM) is adjusted accordingly. Although FIG. 3 provides a schematic of a pressure washer and control system according to one embodiment, alternative arrangements and systems are further contemplated. For example, embodiments are contemplated that do not comprise an ECU, and wherein functioning of a pressure washer device is controlled remotely, such as by one or more user-operated controls located proximal a user including on a spray gun or other remote control device.

As also shown in FIG. 3, a speed control relay 66 or other electrically operated switch is provided to selectively control a circuit using a lower-power signal. The speed control relay may be automatically controlled or operated by the ECU 58 and interconnected sensors, and/or may be overridden by a user such as when a pressure washing device is intended to be operated without automatic adjustment of engine parameters or "auto-idle" features. A speed control switch 68 is preferably in communication with the speed control relay 66 to allow a user to selectively control or adjust an engine speed. In certain embodiments a lighting element is provided in communication with the battery 54, control unit 58 and/or speed control switch 68.

Figure 4A:
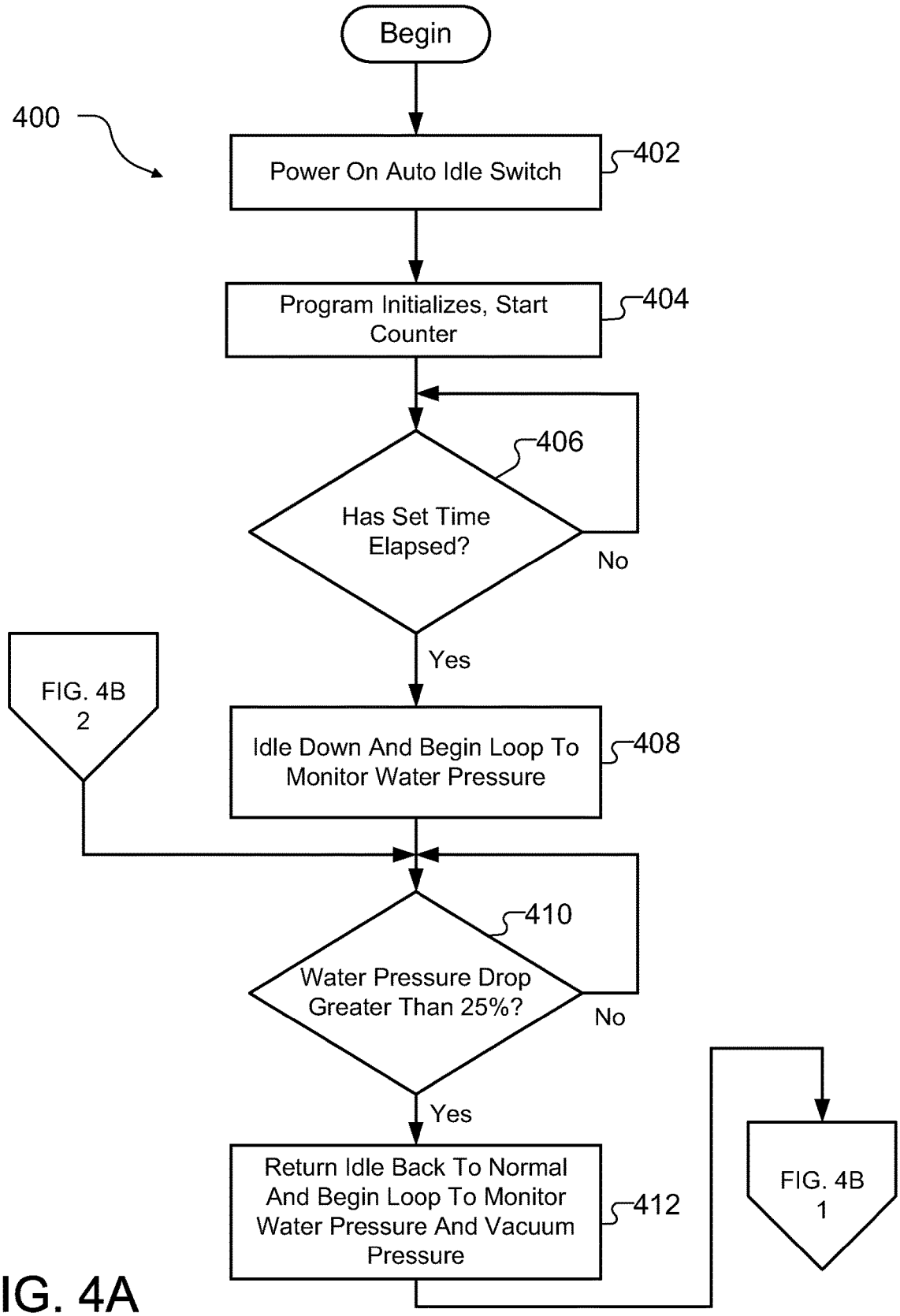
FIGS. 4A and 4B are flow charts of a method of using an electronic control unit in accordance with one embodiment of the present disclosure.
Figure 4B:
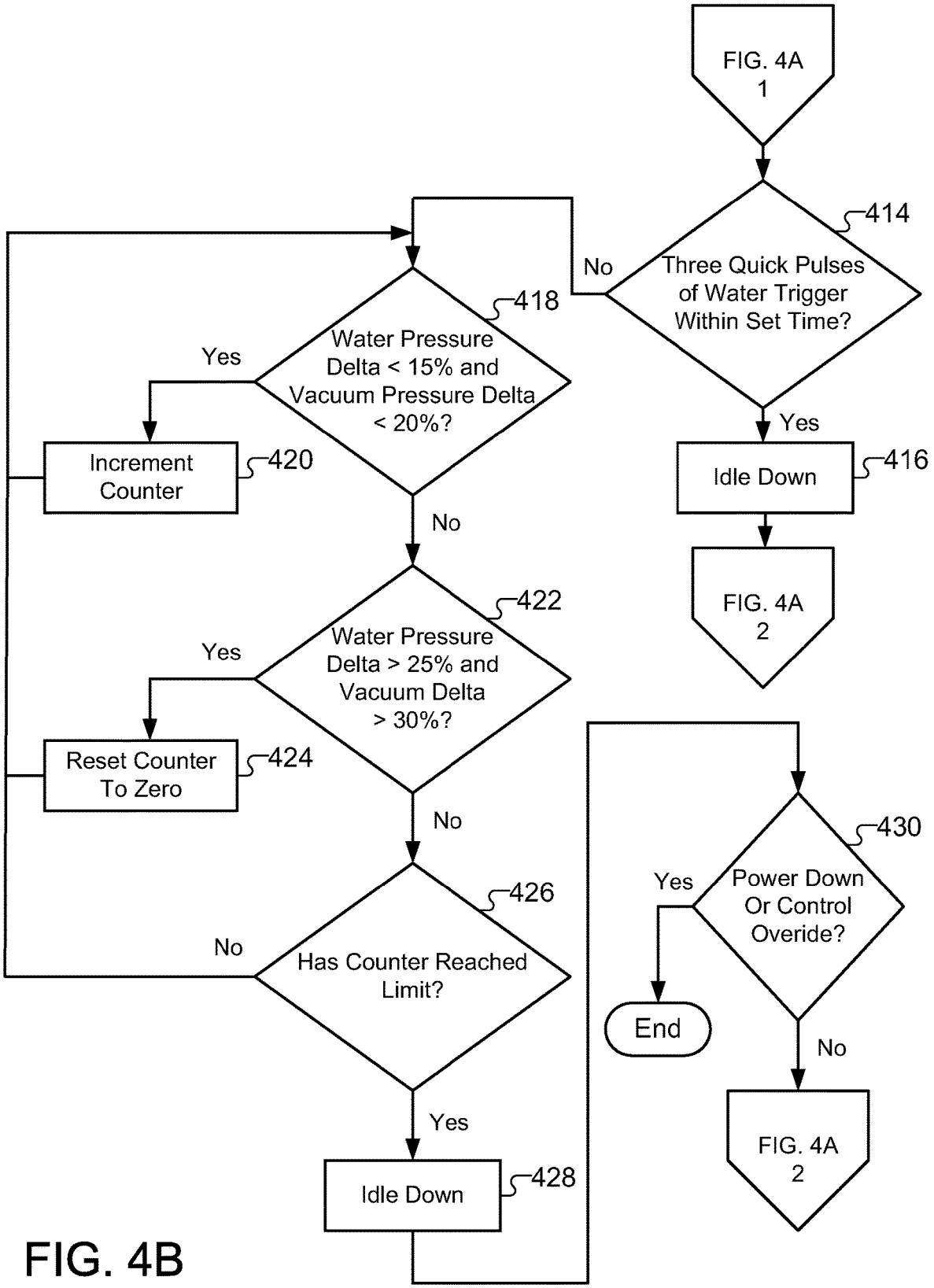

FIGS. 4A-4B are flow charts depicting a method 400 of using an electronic control unit in accordance with one embodiment of the present disclosure. Referring now to FIG. 4A, the method begins in step 402 where a power washer is powered on and an auto-idle activation switch of the electronic control unit is engaged. In various embodiments, auto-idle activation switches of the present disclosure comprise various mechanical, electrical, and/or electromechanical switches provided to allow a user to selectively engage auto-idle features as shown and described herein. Auto-idle activation switches of the present disclosure allow a user to selectively operate a device in a standard mode (i.e. without automatic adjustment of device parameters based on working conditions), or in an auto-idle mode utilizing various features and methods shown and described herein. The program of the electronic control unit initializes in step 404, and regardless of any sensor input data, a relay contact opens and a counter begins. The time for the counter can be varied based upon operating parameters desired. Decision step 406 determines if the counter has reached a predetermined interval without a change in pressures or vacuum, thus indicating that the device is not being used. If so, the device idles down to conserve fuel and otherwise increase efficiency. If an event or change is not recognized, the counter loops and continues the monitoring process. If it is determined at step 406 that the predetermined time interval has been reached, then in step 408 the power washer idles down and the program begins a loop to monitor for a change in water pressure. Specifically, step 410 comprises a monitoring loop to determine if there is an appropriate (e.g. 25% or greater) change in water pressure within the pump, which will occur if the water trigger is pressed and washing operations are commenced, for example. If this condition 406 is not met, monitoring of the water pressure continues. If however the condition is met, the program advances to step 412 wherein the program will close a relay contact and return the idle back to an idle mode or state. The program begins a loop watching the water pressure and vacuum pressure. A counter is incremented with every loop. Typically, the cleaning process begins at this point. Control now passes to decision step 414 of FIG. 4B.

Referring now to FIG. 4B, with the engine at a working idle and the relay closed, a decision step 414 is provided to monitor whether or not an activation event of the water trigger occurs. For example, in one embodiment, an activation event comprises three quick pulses of a spray gun trigger within a defined period of approximately two seconds. Such an activation event represents a clear signal from a user that the engine speed should be reduced. If such an activation event occurs, then in step 416 the relay will open and idle down the power washer. This specific triggering may be used to avoid an unintended idle down, and wherein the device requires a specific user input to induce a manual idle-down activated from the gun or otherwise distal to the engine. In certain embodiments, the activation event induces a decrease in an at least one engine speed, fuel intake, and air intake, and wherein the at least one function is reduced by approximately 20% with respect to working conditions. Control then returns to decision step 410 of FIG. 4A.

If it is determined at decision step 414 that the activation event or signal (e.g. three quick pulses) of the water trigger has not occurred within a predetermined timeframe, then control passes to decision step 418. If decision step 418 determines that there is less than a 15% change in water pressure and/or less than a 20% change in vacuum pressure, thereby indicating that pressure washing activities are continuing, then the counter in step 420 will increment and control loops back to decision step 418. Such a situation indicates that a change in use of the device has not occurred.

If the determination in decision step 418 is that the condition has not occurred (i.e. the result is "no"), thus indicating that washing functions have changed and an alteration to engine speed or power may need to be made, then control passes to decision step 422 to determine if an change of appropriate magnitude has occurred. In the depicted embodiment, step 422 determines if a vacuum pressure delta is greater than 30% and/or if the water pressure delta is greater than 25%. If such conditions exist, thereby indicating that the change is device usage is significant, the process advances to step 424 and the counter is reset to zero and control loops back to decision step 418. In this manner, the counter or loop is reset and the engine function continues as normal and the method continues to monitor for a state of inactivity or reduced usage. If decision step 422 indicates that a change in water pressure and/or vacuum is not significant enough to merit continued engine functioning to support washing operations, decision step 426 then determines if the counter has reached a limit, which in one embodiment is approximately twenty seconds. The count frequency, and thus, the elapsed time in seconds, can be varied to be greater than or less than twenty seconds based upon operating conditions desired. If a condition is not met within the predetermined time, control loops back to decision step 418 and normal or working engine functioning is maintained.

As shown and described, a process of monitoring of pressure washing functions comprises decision steps 418 and 422. As long as water pressure and/or vacuum pressure remain substantially unchanged in step 418, a counter will continue to increment (step 420). If the counter reaches a certain predetermined value without the system having registered an appropriate change in water pressure or vacuum pressure, a control unit may automatically adjust engine function. If water pressure and/or vacuum pressure changes fail to remain below a certain threshold ("no" in step 418), the system then monitors whether or not the changes in such criteria are greater than predetermined values. If the changes are greater than the predetermined values ("yes" in step 422), thus indicating that the device is in use, the counter is reset at step 424 and the loop continues. If the changes are not greater than the predetermined values ("no" at step 422), thus indicating that the device is generally not in use, and the counter has reached a limit ("yes" in step 426), the system recognizes that changes indicative of use have not occurred within a set time period and the device or system functioning is automatically adjusted or idled-down.

If step 426 determines that the condition has been met, the process advances to step 428 wherein the contact to the relay opens and the power washer idles down. The depicted process then advances to decision step 430, wherein the device may be completely powered down or the auto-idle control may be overridden. If the device is powered-down, the process reaches a conclusion. If an over-ride is selected, control loops back to decision step 410 of FIG. 4A.

Although FIGS. 4A-4B and the foregoing describe one embodiment of the present disclosure wherein power washer engine parameters are monitored and appropriate responses are produced by the device and the control unit, it will be expressly recognized that the present disclosure is not limited to the operation of the described sequences and parameters. As discussed, the presently disclosed systems contemplate monitoring various parameters and providing appropriate response(s). For example, in one embodiment, a temperature sensor (e.g. thermocouple) monitors the temperature of the unit at one or more locations and based on temperature readings and certain predetermined parameters, engine functions (e.g. RPM, cooling fans, etc.) are adjusted accordingly.

Although various system embodiments are contemplated as providing vacuum, water, and temperature sensors, it will be recognized that the present invention is not limited to such devices. Indeed, various other means for sensing various other parameters may be utilized in described embodiments, either in combination with or in lieu of the sensors described herein.

What is claimed is:

1. A pressure washer comprising:

an engine having a throttle to control an engine speed and responsive to control signals;

a pump that discharges a fluid under pressure, the pump being in communication with and powered by the engine;

a spray gun in communication with the pump;

a control unit in communication with the engine; and a sensor in communication with the pump and the control unit, the sensor configured to measure a fluid pressure associated with the pump;

wherein the control unit is in communication with the engine to control an engine function so as to change a mode of the pressure washer between a normal mode and an idle mode based on the fluid pressure measured by the sensor, the engine function comprising at least one of engine speed, fuel consumption, and air intake; and wherein the control unit is configured to change the mode of the pressure washer from the normal mode to the idle mode in response to detecting a trigger activation event generated within a defined time period by operating the spray gun, and wherein the trigger activation event is three fluid-pressure changes within the defined period of time caused by operating a trigger assembly of the spray gun.

2. The pressure washer of claim 1, wherein the control unit comprises an electronic control unit in electronic communication with the sensor and the engine.

3. The pressure washer of claim 1, wherein the spray gun is in fluid communication with the pump, and in electrical communication with the control unit.

4. The pressure washer of claim 1, wherein at least one of the engine and the pump are provided on a skid configured to be mounted in a vehicle.

5. The pressure washer of claim 1, wherein the throttle comprises an electromechanical switch in communication with the control unit to variably control the throttle.

6. The pressure washer of claim 1, wherein the control unit is in communication with a switch, the switch configured to selectively control a current to the control unit.

7. The pressure washer of claim 1, further comprising a battery coupled to the control unit to provide electrical power to the control unit.

8. The pressure washer of claim 1, further comprising a battery coupled to the control unit to provide electrical power to the control unit.

9. The pressure washer of claim 1, wherein the defined time period is two seconds.

10. A pressure washer comprising:

an engine having a throttle responsive to control signals;

a pump in communication with the engine, the pump being operable to pressurize a fluid;

a dispensing device in fluid communication with the pump;

a pressure sensor in communication with the engine to detect a fluid pressure produced by the pump; and a control unit in communication with the pressure sensor and the throttle, the control unit configured to receive and process signals from the pressure sensor and send signals to the throttle to control engine function to change a mode of the pressure washer between a normal mode and an idle mode based on a trigger activation event generated within a defined time period by operating the dispensing device, wherein the trigger activation event is detected by the pressure sensor, and wherein the trigger activation event is three fluid-pressure changes within the defined time period caused by operating the dispensing device.

11. The pressure washer of claim 10, further comprising:

a temperature sensor in communication with at least one of the engine and the control unit; and a vacuum sensor in communication with the engine to detect a vacuum pressure at the engine.

12. The pressure washer of claim 10, wherein the control unit comprises an electronic control unit in electronic communication with the pressure sensor and the engine.

13. The pressure washer of claim 10, wherein the dispensing device is in fluid communication with the pump, and in electrical communication with the control unit.

14. The pressure washer of claim 10, wherein at least one of the engine and the pump are provided on a skid configured to be mounted in a vehicle.

15. The pressure washer of claim 10, wherein the throttle comprises an electromechanical switch in communication with the control unit to variably control the throttle.

16. The pressure washer of claim 10, wherein the control unit is in communication with a switch, the switch configured to selectively control a current to the control unit.

17. The pressure washer of claim 10, wherein the defined time period is two seconds.

18. A method for operating a pressure washer comprising an engine, a pump, a trigger assembly, a fluid-pressure sensor, and a control unit in communication with the engine and the fluid-pressure sensor, the method comprising:

activating the pressure washer by starting the engine;

initializing a loop wherein the control unit continuously monitors the fluid-pressure sensor to determine whether a predetermined trigger activation event has occurred and wherein the predetermined trigger activation event includes three fluid-pressure changes within a defined time period caused by operating the trigger assembly;

based on the occurrence of the predetermined trigger activation event, providing a signal from the control unit to the engine to automatically change at least one operating function of the pressure washer to change a mode of the pressure washer to an idle mode.

19. The method of claim 18, wherein the at least one operating function of the pressure washer comprises engine speed.

20. The method of claim 18, wherein the loop is a first loop, the predetermined trigger activation event is a first predetermined event, and the signal is a first signal, and wherein the method further comprises:

initiating a second loop to continuously monitor the fluid-pressure sensor to determine whether a second predetermined event has occurred, wherein the second predetermined event comprises a 25% change in a fluid pressure produced by the pump; and based on the occurrence of the second predetermined event, directing a second signal from the control unit to the engine to automatically change the mode from the idle mode to a normal mode.

21. The method of claim 18, wherein the control unit comprises an electrical control unit in communication with the fluid-pressure sensor and the engine.

22. A pressure washer, comprising: a pump configured to discharge a fluid; a trigger assembly operatively coupled to the pump to control the fluid discharge; an engine operatively coupled to the pump to power the pump; a sensor in communication with the pump; and a control unit operatively coupled to the trigger assembly and the engine to control a speed of the engine; wherein the control unit is configured to change the engine speed from a normal speed to an idle speed in response to a trigger activation event generated within a defined time period by the trigger assembly, and wherein the trigger activation event is detected by the sensor, and wherein the trigger activation event is three fluid-pressure changes caused by operating the trigger assembly.

23. A pressure washer, comprising: a pump configured to discharge a fluid; a trigger assembly operatively coupled to the pump to control the fluid discharge; an engine operatively coupled to the pump to power the pump; a sensor in communication with the pump; and a control unit operatively coupled to the trigger assembly and the engine to control a speed of the engine; wherein the control unit is configured to change the engine speed from a normal speed to an idle speed in response to a trigger activation event generated within a defined time period by the trigger assembly; wherein the trigger activation even is detected by the sensor; and wherein the trigger activation event is three fluid-pressure changes caused by operating the trigger assembly, and wherein the defined time period is two seconds.

* * * * *